US010036404B2

(12) United States Patent
Lee

(10) Patent No.: US 10,036,404 B2
(45) Date of Patent: Jul. 31, 2018

(54) TURBO MACHINE SYSTEM

(71) Applicant: Boge Kompressoren Otto Boge GmbH & Co. KG, Bielefeld (DE)

(72) Inventor: Heonseok Lee, Chungcheongbuk-do (KR)

(73) Assignee: BOGE KOMPRESSOREN Otto Boge GmbH & Co. KG, Bielefeld (DE)

( * ) Notice: Subject to any disclaimer, the term of this patent is extended or adjusted under 35 U.S.C. 154(b) by 321 days.

(21) Appl. No.: 14/436,654

(22) PCT Filed: Sep. 12, 2013

(86) PCT No.: PCT/KR2013/008241

§ 371 (c)(1),
(2) Date: Apr. 17, 2015

(87) PCT Pub. No.: WO2014/061918

PCT Pub. Date: Apr. 24, 2014

(65) Prior Publication Data

US 2015/0247506 A1 Sep. 3, 2015

(30) Foreign Application Priority Data

Oct. 19, 2012 (KR) ..... 10-2012-0116488
Feb. 6, 2013 (KR) ..... 10-2013-0013195

(51) Int. Cl.
*F04D 29/58* (2006.01)
*F04D 17/10* (2006.01)
(Continued)

(52) U.S. Cl.
CPC ..... *F04D 29/5806* (2013.01); *F04D 17/105* (2013.01); *F04D 19/00* (2013.01);
(Continued)

(58) Field of Classification Search
CPC ..... F04D 29/5806; F04D 29/5826; F04D 17/105; F04D 25/082; H02K 5/18; H02K 5/20
See application file for complete search history.

(56) References Cited

U.S. PATENT DOCUMENTS 3,088,042 A * 4/1963 Robinson ..... H02K 9/20 310/54
5,519,269 A * 5/1996 Lindberg ..... H02K 9/19 310/58
(Continued)

FOREIGN PATENT DOCUMENTS

CN 1461895 A 12/2003
EP 1614982 A2 1/2006
(Continued)

OTHER PUBLICATIONS

European Patent Office, Supplementary European Search Report (on a related application), dated Sep. 16, 2016.
(Continued)

*Primary Examiner* — Kenneth J Hansen
(74) *Attorney, Agent, or Firm* — Laurence P. Colton; Smith Tempel Blaha LLC

(57) ABSTRACT

A turbo machine system having an intake structure for air inflow and a cooling structure for a driving motor, and including a driving unit having a rotor and a stator, a compression unit having an impeller that rotates in conjunction with the rotor, guide piping that guides driving unit cooling fluid that flows into the driving unit and is discharged to the outside through the inside of the driving unit and into the compression unit, and external fluid inflow piping that is provided on one side of the guide piping and is provided to communicate with the guide piping, the external fluid inflow piping guiding the external fluid by the
(Continued)

differential pressure between the end of the external fluid inflow piping and the inside of the guide piping so as to flow into the guide piping.

5 Claims, 8 Drawing Sheets

(51) Int. Cl.

| | |
|---|---|
| ***F04D 25/08*** | (2006.01) |
| ***F04D 29/42*** | (2006.01) |
| ***F04D 19/00*** | (2006.01) |
| ***F04D 25/06*** | (2006.01) |

(52) U.S. Cl.
CPC ..... *F04D 25/06* (2013.01); *F04D 25/082* (2013.01); *F04D 29/4213* (2013.01); *F04D 29/5826* (2013.01); *F05D 2250/51* (2013.01)

(56) References Cited

U.S. PATENT DOCUMENTS

| | | | | |
|---|---|---|---|---|
| 8,087,401 | B2 | 1/2012 | Inoue | |
| 2003/0059315 | A1 | 3/2003 | Choi | |
| 2007/0018516 | A1* | 1/2007 | Pal | F04D 25/082 310/61 |

FOREIGN PATENT DOCUMENTS

| | | | | |
|---|---|---|---|---|
| EP | 1826887 | A2 | 8/2007 | |
| EP | 2444627 | A1 * | 4/2012 | F02B 37/04 |
| JP | 11201098 | A | 7/1999 | |
| JP | 2002138962 | A | 5/2002 | |
| JP | 2003056469 | A | 2/2003 | |
| JP | 2005127307 | A | 5/2005 | |
| JP | 2007332826 | A | 12/2007 | |
| JP | 2012072690 | A | 4/2012 | |
| KR | 100481600 | B1 | 4/2005 | |
| KR | 100530692 | B2 | 11/2005 | |
| WO | 99/13223 | A1 | 3/1999 | |
| WO | 9913223 | A1 | 3/1999 | |

OTHER PUBLICATIONS

European Patent Office, Supplementary Partial European Search Report (on related application), dated Mar. 23, 2015.
WIPO, International Search Report on parent application, dated Jan. 17, 2014.
State Intellectual Property Office of the People'S Republic of China, Notification of the First Office Action (in a related application), dated Jun. 29, 2016.

* cited by examiner

TURBO MACHINE SYSTEM

FIELD OF THE INVENTION

The present disclosure relates to a turbo machine system, and more particularly, to a turbo machine system having an intake structure for air inflow and a cooling structure of a driving motor to provide improved compression efficiency.

BACKGROUND

This section provides background information related to the present disclosure which is not necessarily prior art.

Turbo machine systems represents systems for compressing a working fluid (for example: air) or increasing a flow rate by using turbo machines such as turbo compressors, turbo blowers, and turbo fans.

The conventional turbo machine has realized a high-speed rotation of a motor that rotates at a constant speed by using a speed increasing gear. However, in recent years, as bearing and inverter technologies have developed, a direct type high-speed rotation technology in which the turbo machine is directly connected to the motor is being applied.

However, although the turbo machine has the advantage of reducing the whole volume by the direct type high-speed rotation technology, cooling efficiency of a driving motor has a large part in overall efficiency of the turbo machine system.

FIG. 1 is a schematic view illustrating an example of a turbo machine system according to a related art.

Referring to FIG. 1, the turbo machine system according to the related art includes a driving unit for generating overall power, a compression unit for performing a series of operations such as intake, compression, and discharge of a working fluid by using the driving unit, a support unit for supporting the driving unit and the compressing unit to couple the driving unit to the compression unit, and a guide piping unit for guiding a flow of the working fluid.

The driving unit is provided with a motor constituted by a driving shaft (211), a rotor (212), and a stator (213) and is supported by the support unit including a casing (221) that surrounds the outside of the driving unit.

Since heat is mostly generated from the driving unit, in order to prevent the heat generated from the driving unit from being conducted to the compression unit, gaps (260*a* and 260*b*) are defined between the compression unit and the driving unit when assembled.

Meanwhile, in order to cool the driving unit, the casing (221) has a cooling fluid intake hole (241) that is defined in one side thereof to introduce the cooling fluid for cooling the driving unit and a cooling fluid discharge hole (242) that is defined in the other side thereof to discharge the cooling fluid that has cooled the inside of the driving unit.

Also, in order to improve cooling efficiency of the driving unit by using the cooling fluid suctioned into the casing (221), heat dissipation fins (214, 225*a*, 225*b*) are disposed on an outer circumferential surface of the stator (213) and outer circumferential surfaces of bearing housings (224*a*, 224*b*).

There is an example in which a cooling jacket for circulating coolant to dissipate the heat is disposed on the casing instead of the heat dissipation fins (214, 225*a*, 225*b*), or a fan for cooling is disposed.

The compression unit is provided with impellers (231*a*, 231*b*) rotated by the driving unit and impeller housing parts (233*a*, 234*a*, 233*b*, 234*b*) accommodating the impellers (231*a*, 231*b*) and having intake holes and discharge holes to guide the working fluid introduced into, compressed in, and discharged from the impellers (231*a*, 231*b*).

The compression unit may be symmetrically disposed on both sides of the driving unit as illustrated in FIG. 1 and may be disposed on only one side of the driving unit.

Meanwhile, the turbo machine system according to the related art discloses a piping structure for improving cooling efficiency of the driving unit, i.e., air circulation passages (236*s*, 236*b*) through which the cooling fluid discharge hole (242) of the driving unit communicates with the intake hole of the compression unit as illustrated in FIG. 1.

The cooling fluid discharged from the cooling fluid discharge hole (242) through the air circulation passages (236*a*, 236*b*) is guided to the intake hole of the compression unit. As a result, there is an advantage in controlling an amount of cooling fluid for cooling the driving unit according to a variation in rotation speed of the driving unit.

That is, when the driving unit increases in amount of heat generation due to an increase in rotation speed of the driving unit, the working fluid introduced into the intake hole of the compression unit increases in amount. Thus, an amount of cooling fluid for cooling the driving unit increases to activate the cooling of the driving unit. In a contrary case, the cooling fluid for cooling the driving unit may decrease in amount.

However, since the above-described turbo machine system according to the related art uses only the cooling fluid that is heated while the working fluid suctioned into the compression unit cools the driving unit, the compression unit may deteriorate in compression efficiency.

DETAILED DESCRIPTION OF THE INVENTION

Technical Problem to be Solved

An object of the present invention is to provide a turbo machine system that uses a cooling fluid, which is suctioned into a compression unit after cooling the driving unit, as a working fluid and reduces a temperature of the working fluid suctioned into the compression unit to improve compression efficiency of the compression unit.

Also, another object of the present invention is to provide a turbo machine system in which a flow rate of a cooling fluid supplied into a driving unit to cool the driving unit is controlled according to a rotation speed of the driving unit.

Also, another further object of the present invention is to provide a turbo machine system in which an inner passage of a driving unit for a cooling fluid introduced into the driving unit is improved to improve cooling efficiency of the driving unit.

Technical Solutions

A turbo machine system according to an embodiment of the present invention includes: a driving unit having a rotor and a stator; a compression unit having an impeller interlocked with the rotor to rotate; a guide piping for guiding a driving unit cooling fluid, which is introduced into the driving unit and discharged to the outside after passing through the inside of the driving unit, into the compression unit; and an external fluid inflow piping disposed on one side of the guide piping to communicate with the guide piping, wherein the external fluid inflow piping guides an external fluid set by a differential pressure between an end of the external fluid inflow piping and the inside of the guide piping is introduced into the guide piping.

Here, the external fluid inflow piping may have one end that communicates with the inside of the guide piping and another end that is exposed to air.

Also, the external fluid inflow piping may have one end that communicates with the inside of the guide piping and another end that communicates with an external fluid storage part in which the set external fluid is stored.

Also, the external fluid inflow piping may further include a valve member for adjusting an inflow rate of the set external fluid.

Also, the valve member may be controlled in operation according to a rotation speed of the driving unit.

Also, the impeller may be accommodated in an impeller housing having an inflow hole and a discharge hole, and the external fluid inflow piping may communicate with the inflow hole.

Also, the driving unit may further include a driving unit casing for supporting the rotor and the stator, and the driving unit casing may include: a cooling fluid inflow hole that communicates with the outside; and a cooling fluid discharge hole that communicates with the guide piping.

Also, the stator may include a stator iron core and a stator winding part in which a coil is wound around the stator iron core, and the cooling fluid inflow hole is defined toward the stator winding part, and the stator iron core has a plurality of through-holes passing from the cooling fluid discharge hole toward the rotor, and a gap is defined between the rotor and the stator so that the driving unit cooling fluid passing through the stator winding part passes through the gap.

Also, the driving unit cooling fluid may cool the driving unit while being introduced through the cooling fluid inflow hole to pass through the gap between the stator and the rotor via the stator winding part and being discharged to the cooling fluid discharge hole through the plurality of through holes.

Also, the guide piping may further include a heat exchange unit for cooling the driving unit cooling fluid that is discharged after cooling the driving unit.

Meanwhile, a turbo machine system according to another embodiment of the present invention includes: a first driving part having a rotor and a stator; a first compression part having an impeller interlocked with the rotor of the first driving part to rotate; a first guide piping for guiding a first driving part cooling fluid, which is introduced into the first driving part and discharged to the outside after passing through the inside of the first driving part, into the first compression part; a second driving part independently disposed with respect to the first driving part, the second driving part having a rotor and a stator; a second compression part having an impeller interlocked with the rotor of the second driving part to rotate; a second guide piping for guiding a second driving part cooling fluid, which is introduced into the second driving part and discharged to the outside after passing through the inside of the second driving part, into the first compression part; and an external fluid inflow piping communicating with at least one of the first guide piping and the second guide piping, wherein the external fluid inflow piping is disposed so that a set external fluid is introduced into the first compression part therethrough.

Here, the external fluid inflow piping may be disposed to allow the first guide piping to communicate with the second guide piping in a state where the first and second guide pipings are combined with each other.

Also, the first guide piping may communicate with the inside of the second driving part to communicate with the first compression part by successively passing through the second driving part and the second guide piping.

Also, the external fluid inflow piping may have one end that communicates with one of the first and second guide pipings and another end that is exposed to air.

Also, the external fluid inflow piping may have one end that communicates with one of the first and second guide pipings and another end that communicates with an external fluid storage part in which the set external fluid is stored.

Also, the external fluid inflow piping may further include a valve member for adjusting an inflow rate of the set external fluid.

Also, the valve member may be controlled in operation according to a rotation speed of the first driving unit.

Also, the turbo machine system may further include a third guide piping for guiding the fluid discharged from the first compression part into the second compression part.

Also, the turbo machine system may further include a third compression part having an impeller interlocked with the rotor of the first driving part to rotate, the third compression part being independently disposed with respect to the first compression part; a fourth guide piping for guiding the fluid discharged from the first compression part into the third compression part; and a fifth guide piping for guiding the fluid discharged from the third compression part into the second compression part.

Effect of the Invention

In the turbo machine system according to the embodiment of the present invention, the external fluid having a relatively low temperature together with the cooling fluid that has cooled the driving unit may be simultaneously suctioned into the compression unit. Thus, the working fluid suctioned into the compression unit may decrease in temperature to improve the compression efficiency of the compression unit.

Also, in the turbo machine system according to the embodiment of the present invention, the external fluid having a relatively low temperature and suctioned into the compression unit may be controlled in flow rate to control an optimal flow rate of the air to be suctioned into the driving unit to cool the driving unit.

Also, in the turbo machine system according to the embodiment of the present invention, since the cooling fluid suctioned into the driving unit to cool the driving unit cools the inside of the driving unit while passing through the passage defined in the driving unit, the driving unit may be improved in cooling efficiency.

DESCRIPTIONS OF ACCOMPANYING DRAWINGS

MODE FOR INVENTION

Hereinafter, embodiments of a turbo machine system according to the present invention will be described in detail with reference to the accompanying drawings.

The terms or words used in the detailed description of the invention and the appended claims will not be limited to encyclopedic means, and all differences within the scope will be construed as being included in the present invention. The description of the present invention is intended to be illustrative, and those with ordinary skill in the technical field to which the present invention pertains will understand that the present invention can be carried out in other specific forms without changing the technical idea or essential features.

Figure 1:
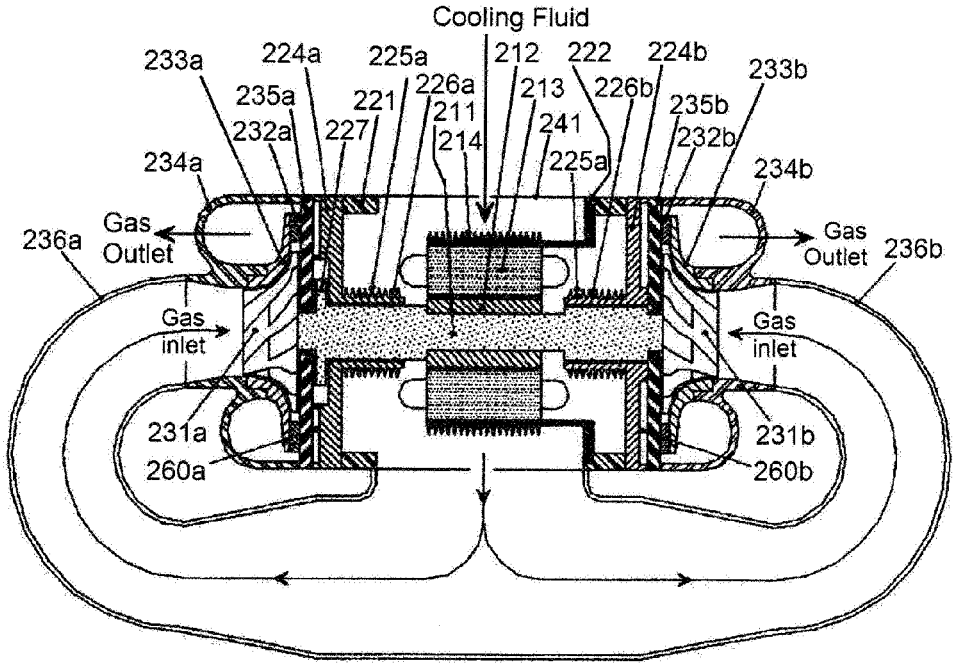
FIG. 1 (prior art)
FIG. 1 is a schematic view illustrating an example of a turbo machine system according to the related art.
Figure 2:
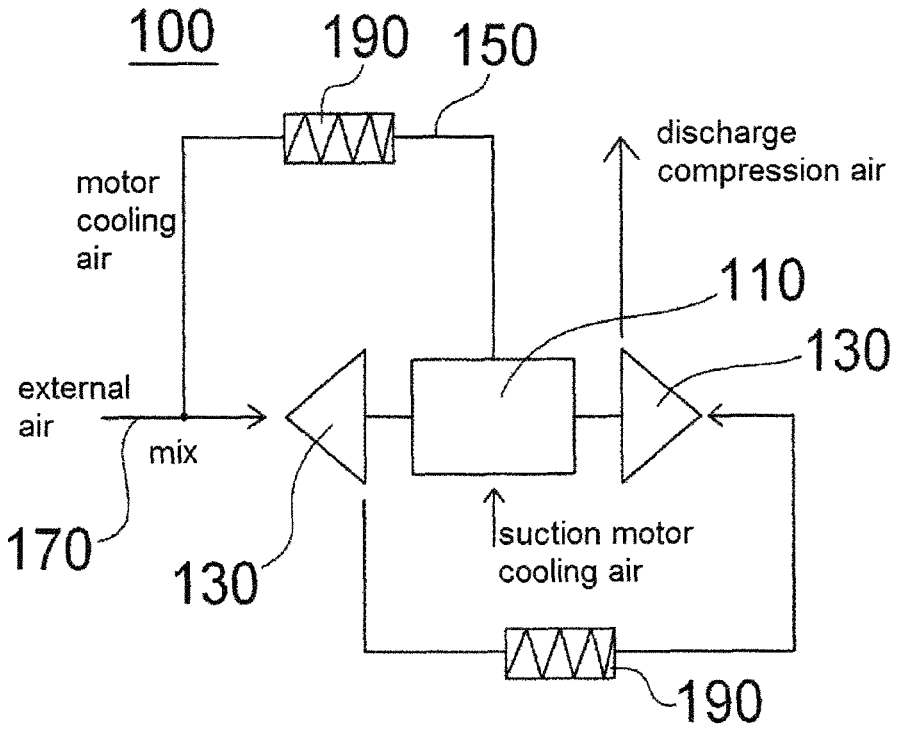
FIG. 2 is a schematic view illustrating constitutions of the turbo machine system according to an embodiment of the present invention.
Figure 3:
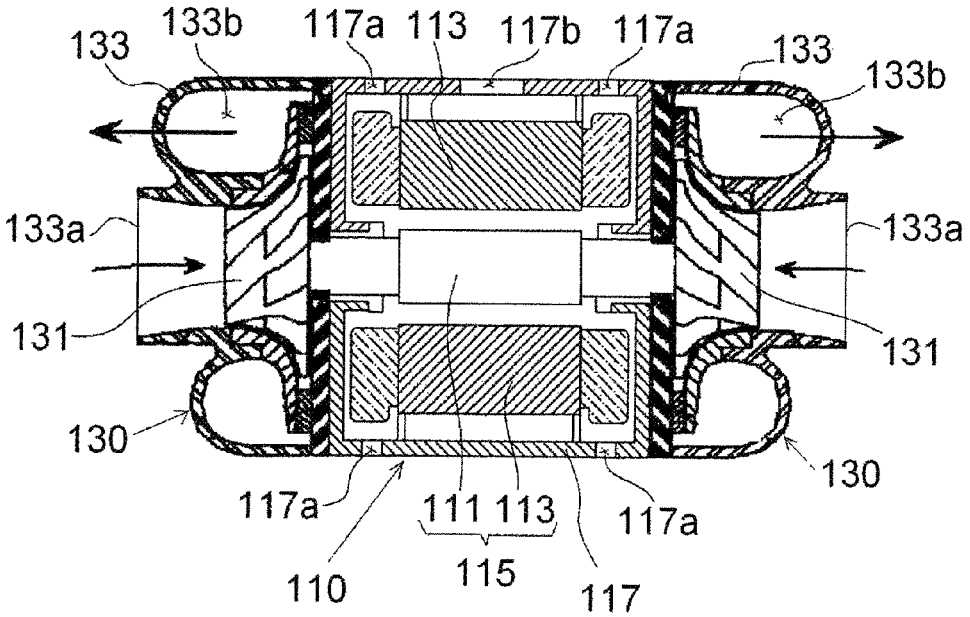
FIG. 3 is a schematic view illustrating constitutions of a driving unit and a compression unit of FIG. 2.

FIG. 2 is a schematic view illustrating constitutions of the turbo machine system according to an embodiment of the present invention, and FIG. 3 is a schematic view illustrating constitutions of a driving unit and a compression unit of FIG. 2.

Referring to FIGS. 2 and 3, a turbo machine system (100) according to the present embodiment includes a driving unit (110), a compression unit (130), a guide piping (150), and an external fluid inflow piping (170).

The driving unit (110) includes a motor (111) having a rotor (113) and a stator (115) and a driving unit casing (117) surrounding an outer circumference of the motor (111).

It is preferable that the motor (ill) is provided with a permanent magnetic (PM) motor; however, in an embodiment of the turbo machine system (100) according to the present embodiment, the motor will not be limited to the type thereof.

The driving unit casing (117) may preferably have a structure in which the driving unit casing supports the rotor (113) and the stator (115), and a driving unit cooling fluid (for example: air) for cooling the driving unit (110) is introduced into and discharged from the inside of the driving unit (110).

In detail, it is preferable that the driving casing (117) has a cooling fluid inflow hole (117*a*) and a cooling fluid discharge hole (117*b*) that are respectively defined in one and the other sides of the driving casing (117) to introduce and discharge the driving unit cooling fluid.

The compression unit (130) includes an impeller (131) shaft-coupled to the rotor (113) of the motor (111) to rotate together with the rotor (113).

The impeller (131) has a structure in which a working fluid (for example: air) is axially introduced and radially discharged.

For this, it is preferable that the impeller (131) is accommodated in an impeller housing (133) having an inflow hole (133*a*) that is axially opened and a discharge hole (133*b*) guiding the working fluid that is radially discharged.

Meanwhile, the guide piping (150) is provided so that the cooling fluid discharge hole (117*b*) of the driving unit casing (117) communicates with the inflow hole (133*a*) of the compression unit (130).

The driving unit cooling fluid discharged from the driving unit casing (117) is supplied into the compression unit (130) through the guide piping (150).

However, since the driving cooling fluid discharged from the driving unit casing (117) is in a state in which the temperature of the driving unit casing increases due to heat of the driving unit (110), when the driving unit cooling fluid having an increased temperature is introduced into the compression unit (130), the compression unit (130) may deteriorate in compression efficiency like the related art.

To prevent the compression efficiency from deteriorating, an external fluid inflow piping (170) communicating with the guide piping (150) is disposed so that an external fluid having a relatively low temperature when compared to the driving unit cooling fluid introduced into the compression unit (130) is introduced.

In detail, when the impeller (131) of the compression unit (130) rotates by the rotation of the driving unit (110), the inflow hole (133*a*) defined in the compression unit (130) may decrease in pressure. Thus, a pressure gradient may be generated between the inflow hole (133*a*) of the driving unit (110) and the cooling fluid inflow hole (117*a*) of the driving unit casing (117). As a result, the driving unit cooling fluid is introduced into the driving unit (110), and the driving unit cooling fluid which cools the driving unit is introduced into the compression unit (130) through the guide piping (150).

At the same time, when the impeller (131) of the compression unit (130) rotates by the rotation of the driving unit (110), the inflow hole (133*a*) defined in the compression unit (130) may decrease in pressure, and thus the external fluid may be introduced into the inflow hole (133*a*) of the compression unit (130) through the external fluid inflow piping (170).

Since the external fluid introduced into the inflow hole (133*a*) of the compression unit (130) through the external fluid inflow piping (170) has a relatively low temperature when compared to the driving unit cooling fluid introduced into the inflow hole (133*a*) of the compression unit (130), as a result, the working fluid introduced into the compression unit (130) may decrease in temperature due to mixing of the external fluid and the driving unit cooling fluid to improve compression efficiency of the compression unit (130).

Here, although the external fluid inflow piping (170) generally has a piping shape, a hole-shaped external fluid inflow piping may be allowable so that the external fluid is introduced into the guide piping (150).

Meanwhile, the external fluid may be provided as air or a specific gas. It is preferable that the external fluid is provided with the same fluid as the driving unit cooling fluid.

When the external fluid is the air, it is preferable that the external fluid inflow piping (170) has one end that communicates with the inside the guide piping (150) and another end that is exposed to the air.

Alternatively, when the external fluid is the specific gas, it is preferable that the external fluid inflow piping (170) has one end that communicates with the inside of the guide piping (150) and another end that communicates with an external fluid storage part in which the specific external fluid is stored. In this case, it is preferable that the external fluid storage part communicates with the cooling fluid inflow hole (117*a*) of the driving unit casing (117).

Meanwhile, in the turbo machine system (100) according to the present embodiment, it is preferable that a heat exchange unit (190) for cooling the driving unit cooling fluid discharged after cooling the driving unit (110) is further disposed on the guide piping (150).

Since a flow rate of the driving unit cooling fluid passing through the heat exchange unit (190) disposed according to the present embodiment is relatively small when compared to the related art, the heat exchange unit may have relatively small size.

Figure 4:
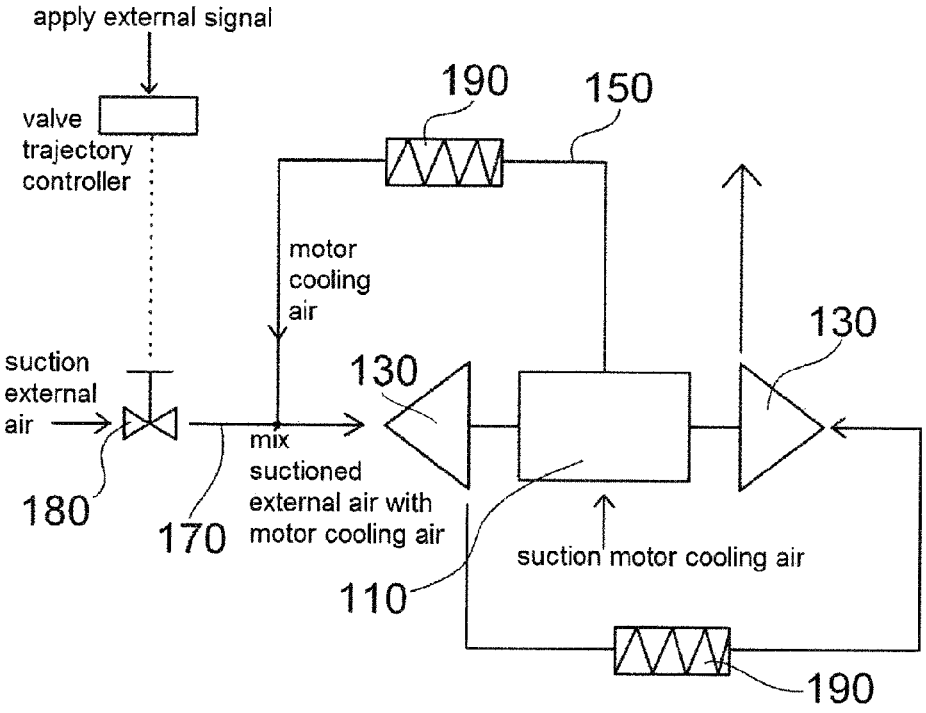
FIG. 4 is a view of another example of FIG. 2.

Next, FIG. 4 is a view of another example of FIG. 2.

In the present embodiment, although most of the constitutions are almost the same as those in the above-described example, there is a difference in that the external fluid inflow piping (170) has additional constitutions. Thus, descriptions of other constitutions except for the additional constitutions disposed in the external fluid inflow piping (170) will be the same as those of the above-described examples.

Referring to FIG. 4, in the turbo machine system (100) according to the present embodiment, the external fluid inflow piping (170) may further have a valve member (180) for adjusting an inflow rate of the external fluid.

The valve member (180) is provided to control the flow rate of the external fluid through the external fluid inflow piping (170).

In detail, as the valve member (180) increases in opening degree, the external fluid gradually increases in flow rate. Similarly, as the valve member (180) decreases in opening degree, the external fluid gradually decreases in flow rate.

As a result, since the flow rate of driving unit cooling fluid introduced through the guide piping (150) increases when the inflow rate of the external fluid is low, the driving unit cooling fluid introduced into the cooling fluid inflow hole (117*a*) increases to actively cool the driving unit (110). This may be adopted when the driving unit (110) has a relatively high rotation speed.

When the driving unit (110) has a relatively low rotation speed, the valve member (180) may increase in opening degree to increase the inflow rate of the external fluid, thereby improving compression efficiency.

Meanwhile, it is preferable that the valve member (180) is controlled in opening degree thereof according to the rotation speed of the driving unit (110).

Alternatively, it is preferable that the valve member (180) is controlled in opening degree thereof according to a pressure required at an outlet of the compression unit (130), i.e., a load of the compression unit (130).

Figure 5:
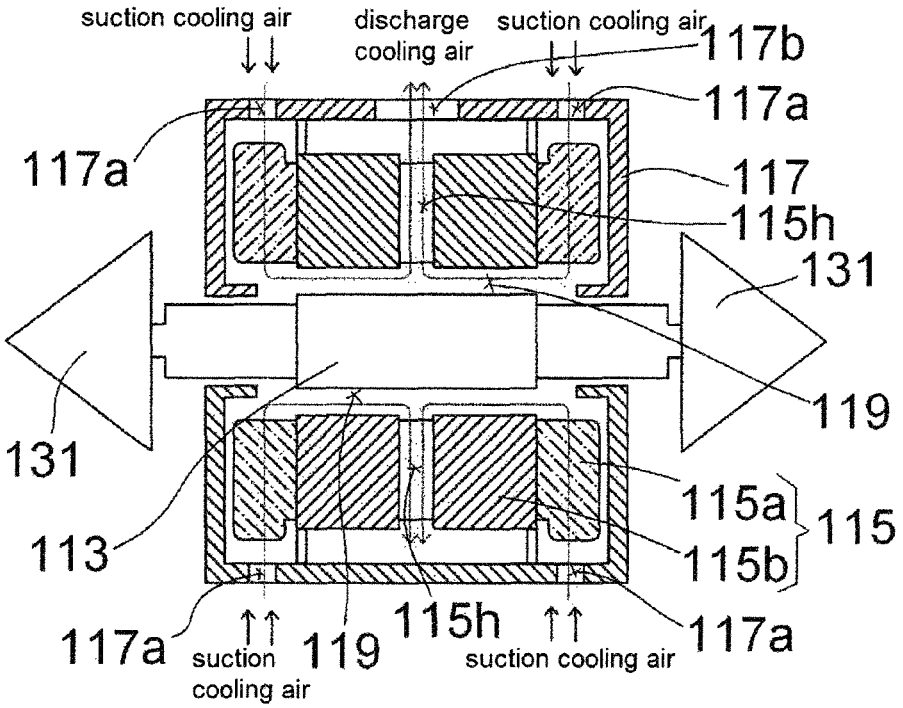
FIG. 5 is a view illustrating an example of a cooling structure of the driving unit of the turbo machine system according to an embodiment of the present invention.

Next, FIG. 5 is a view illustrating an example of a cooling structure of the driving unit in the turbo machine system according to an embodiment of the present invention.

In the turbo machine system (100) according to the present embodiment, although most of the constitutions are selected and adopted from the constitutions according to any one of the above-described examples, there is a difference in an internal structure of the driving unit (110). Thus, descriptions of other constitutions except for the internal structure of the driving unit (110) will be the same as those of the above-described examples.

Referring to FIG. 5, in the turbo machine system (100) according to the present embodiment, the stator (115) has a stator iron core (115*b*) and a stator winding part (115*a*). The stator iron core (115*b*) has a plurality of through-holes (115*h*) passing from the cooling fluid discharge hole (117*b*) toward the rotor (113). Also, a gap (119) is defined between the rotor (113) and the stator (115) so that the driving unit cooling fluid passes via the stator winding part (115*a*).

The stator winding part (115*a*) means a portion around which a coil is wound. The coil is wound around one side of the stator iron core (115*b*).

In the present embodiment, the stator (115) has a hollow cylindrical shape in a longitudinal direction. The stator winding part (115*a*) is disposed on each of an upper end and a lower end of the stator (115). Also, the rotor (113) has a cylindrical shape and is disposed in the stator (115).

The plurality of through-holes (115*h*) are defined to pass from an outer surface of the stator (115) toward the rotor (113).

In the present embodiment, it is preferable that the cooling fluid inflow hole (117*a*) is defined at a position corresponding to the stator winding part (115*a*). It is preferable that the cooling fluid discharge hole (117*b*) is defined at a position corresponding to each of the plurality of through-holes (115*h*).

Thus, the driving unit cooling fluid introduced through the cooling fluid inflow hole (117*a*) may cool the driving unit while passing through the stator winding part (115*a*) to cool the stator iron core (115*b*) and the rotor (113) while passing through the gap (119) defined between the driving unit (110) and the rotor (113). Then, the driving cooling fluid may cool the stator iron core (115*b*) once more while passing through the plurality of through-holes (115*h*) and thus be discharged outside the driving unit (110) through the cooling fluid discharge hole (117*b*).

Figure 6:
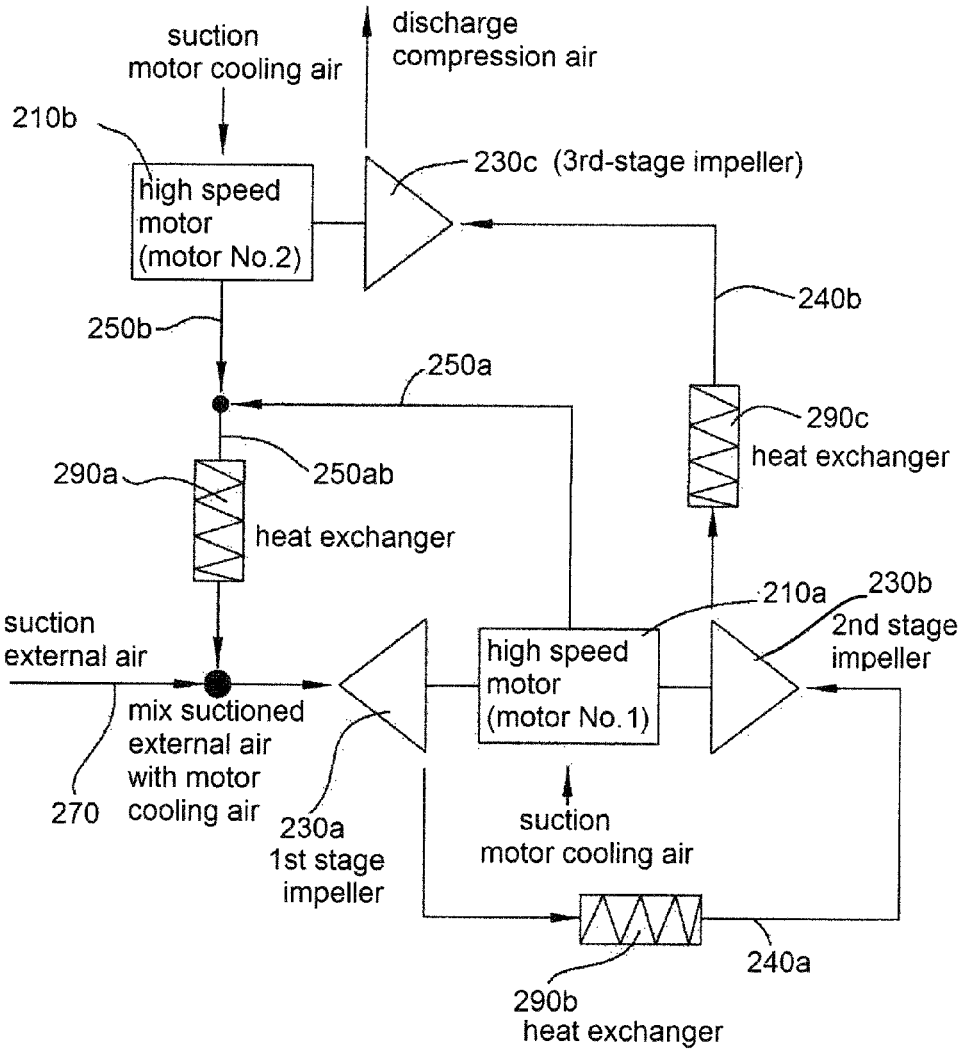
FIG. 6 is a view of another further example of FIG. 2.

Next, FIG. 6 is a view illustrating another example of FIG. 2.

In the present embodiment, there is a difference in that a turbo machine system includes two or more turbo machines unlike the above-described examples. However, since constitutions of the turbo machine are the same as those of the turbo machine in the above-described examples, it will be described with reference to FIG. 3.

Referring to FIGS. 3 and 6, a turbo machine system (200) according to the present embodiment includes a driving unit (210), a compression unit (230), a guide piping (250), and an external fluid inflow piping (270).

The driving unit (210) is constituted with a first driving part (210*a*) and a second driving part (210*b*) that are independently driven. A first compression part (230*a*) and a second compression part (230*b*) are connected to both sides of the first driving part (210*a*), respectively. A third compression part (230*c*) is connected to the second driving part (210*b*).

Each of the first and second driving parts (210*a* and 210*b*) includes the motor (111) having the rotor (113) and the stator (115) and the driving unit casing (117) surrounding the outer circumference of the motor (111).

Although it is preferable that the motor (111) is provided with the permanent magnetic (PM) motor, other types of motors may be applied.

It is preferable that the driving unit casing (117) has a structure in which the driving unit casing supports the rotor (113) and the stator (115), and a driving unit cooling fluid for cooling the driving unit (210) is introduced into and discharged from the inside of the driving unit (210).

In detail, it is preferable that the driving casing (117) has the cooling fluid inflow hole (117*a*) and the cooling fluid discharge hole (117*b*) that are respectively defined in one and the other sides of the driving casing (117) to introduce and discharge the driving unit cooling fluid.

Meanwhile, each of the first, second, and third compression parts (230*a*, 230*b*, and 230*c*) includes the impeller (131) rotated by the first driving part (210*a*) or the second driving part (210*b*).

The impeller (131) has a structure in which the working fluid is axially introduced and radially discharged.

For this, it is preferable that the impeller (131) is accommodated in the impeller housing (133) having the inflow hole (133*a*) that is axially opened and the discharge hole (133*b*) guiding the working fluid that is radially discharged.

The guide piping (250) is constituted with a first guide piping (250*a*) for guiding a first driving unit cooling fluid which cools the inside of the first driving part (210*a*) while passing through the first driving part (210*a*) into the first compression part (230*a*) and a second guide piping (250*b*) for guiding a second driving unit cooling fluid which cools the inside of the second driving part (210*b*) while passing through the second driving part (210*b*) into the first compression part (230*a*).

In detail, each of the first guide piping (250*a*) and the second guide piping (250*b*) guides the first and second driving unit cooling fluids discharged through the cooling fluid discharge hole (117*b*) of the driving unit casing (117) into the first compression part (230*a*).

Meanwhile, the fluid discharged after being introduced into and compressed in the first compression part (230*a*) may be introduced into the second compression part (230*b*) and thus be further compressed. The fluid discharged from the second compression part (230*b*) may be introduced again into the third compression part (230*c*) and additionally compressed and thus be finally discharged.

However, since the driving unit cooling fluid discharged from the driving unit casing (117) is in a state of increasing in temperature due to the heat of the driving unit (210), when the driving unit cooling fluid having an increased temperature is entirely introduced into the first compression part (230*a*), the first compression part (230*a*) may deteriorate in compression efficiency.

To prevent this, the external fluid inflow piping (270) for introducing an external fluid has a relatively low temperature when compared to the temperatures of the first and second driving unit cooling fluids into the first compression part (230*a*).

In detail, when the impeller (131) of the first compression part (230*a*) rotates by rotation of the first driving part (210*a*), a pressure gradient may be generated between the inflow hole (133*a*) of the first compression part (230*a*) and the cooling fluid inflow hole (117*a*) of the first driving part (210*a*). As a result, the first driving unit cooling fluid is introduced into the first driving part (210*a*), and the driving unit cooling fluid which cools the driving part is introduced into the first compression part (230*a*) through the first guide piping (250*a*).

At the same time, when the impeller (131) of the first compression part (230*a*) rotates by the rotation of the first driving part (210*a*), a pressure gradient may be generated between the inflow hole (133*a*) of the first compression part (230*a*) and the cooling fluid inflow hole (117*a*) of the second driving part (210*b*). As a result, the second driving unit cooling fluid is introduced into the second driving part (210*b*), and the second driving unit cooling fluid which cools the driving part is introduced into the first compression part (230*a*) through the second guide piping (250*b*).

Also, when the impeller (131) of the first compression part (230*a*) rotates by the rotation of the first driving part (210*a*), since the inflow hole (133*a*) of the first compression part (230*a*) has a reduced pressure, the external fluid may be introduced into the inflow hole (133*a*) of the first compression part (230*a*) through the external fluid inflow piping (270).

That is, the first and second driving unit cooling fluids guided by the first and second guide pipings (250*a*, 250*b*) and the external fluid introduced from the external fluid inflow piping (270) may be mixed with each other and then introduced into the first compression part (230*a*).

For this, one of the first and second guide pipings (250*a*, 250*b*) and the external fluid inflow piping (270) communicates with the first compression part (230*a*), and the other two pipings communicate with one piping communicating with the first compression part (230*a*).

For example, the external fluid inflow piping (270) communicates with the first compression part (230*a*). The first and second guide pipings (250*a*, 250*b*) are combined with each other. Then, a combined piping (250*ab*) communicates with the external fluid inflow piping (170).

Here, although the external fluid inflow piping (270) generally has a piping shape, the external fluid inflow piping may have a through-hole shape so that the external fluid is introduced into the first and second guide pipings (250*a* and 250*b*), and the combined piping (250*ab*).

Meanwhile, the external fluid may be provided as air or a specific gas. It is preferable that the external fluid is provided with the same fluid as the driving unit cooling fluid.

When the external fluid is air, it is preferable that the external fluid inflow piping (270) has one end that communicates with the inside of the first guide piping (250*a*) or second guide piping (250*b*) and another end that is exposed to the air.

Alternatively, when the external fluid is a specific gas, it is preferable that the external fluid inflow piping (270) has one end that communicates with the inside of the first guide piping (250*a*) or second guide piping (250*b*) and another end that communicates with an external fluid storage part in which the specific external fluid is stored.

Meanwhile, a heat exchanger (290*a*) for cooling the first and second driving unit cooling fluids may be disposed on the combined piping (250*ab*) in which the first guide piping (250*a*) is combined with the second guide piping (250*b*).

This is done to improve the compression efficiency of the first compression part (230*a*) by reducing the temperature of the fluid introduced into the first compression part (230*a*).

Similarly, it is preferable that heat exchangers (290*b*, 290*c*) are disposed on a connection piping (240*a*) for guiding the fluid discharged from the first compression part (230*a*) into the second compression part (230*b*) and a connection piping (240*b*) for guiding the fluid discharged from the second compression part (230*b*) into the third compression part (230*c*), respectively.

In the heat exchanger (290*a*) provided according to the present embodiment, since flow rates of the first driving unit cooling fluid and the second driving unit cooling fluid passing through the heat exchanger are low by an amount corresponding to the inflow rate of the external fluid, the flow rates of the fluids are relatively low when compared to the related art. Thus, the heat exchanger may have a relatively small size.

Figure 7:
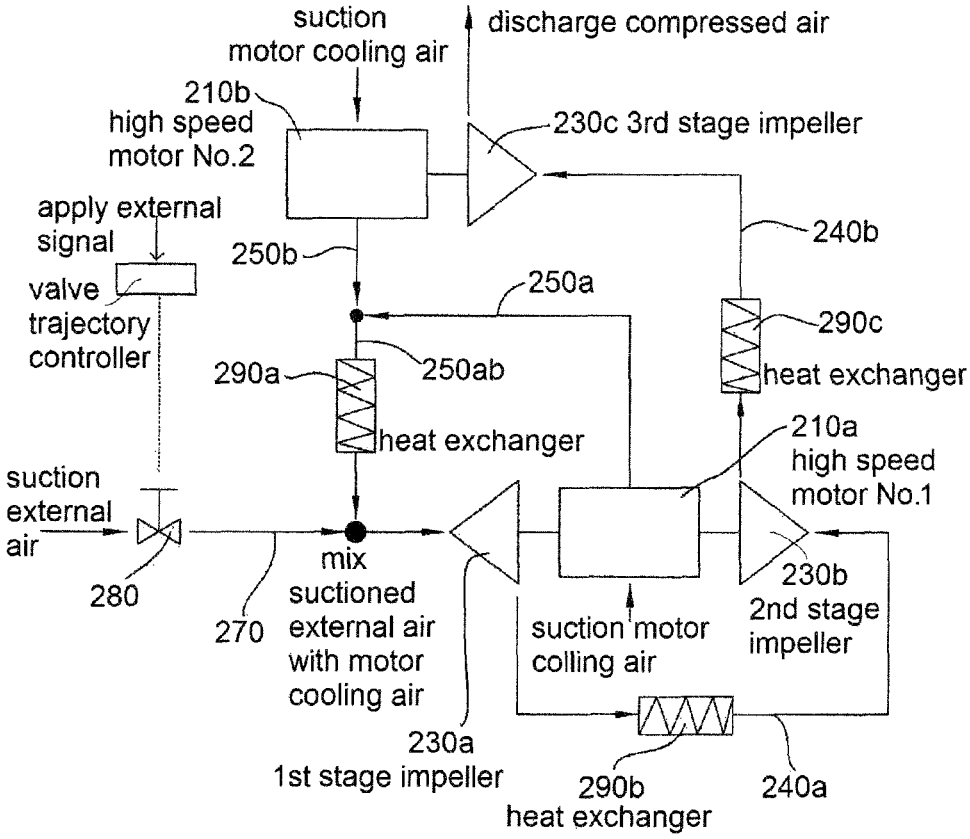
FIG. 7 is a view of another further example of FIG. 6.

Next, FIG. 7 is a view of another example of FIG. 6.

Referring to FIG. 7, in the present embodiment, although most of the constitutions are almost the same as those of the above-described example of FIG. 6, there is a difference in that the external fluid inflow piping (270) has an additional constitution. Thus, descriptions of other constitutions except for the additional constitutions disposed in the external fluid inflow piping (270) will be the same as those of the above-described examples.

Referring to FIG. 7, in the turbo machine (200) according to the present embodiment, the external fluid inflow piping (270) may further have a valve member (280) for adjusting an inflow rate of the external fluid.

As the valve member (280), an automatic valve or an orifice controlled by the external controller may be used.

The valve member (280) is provided to control the inflow rate of the external fluid through the external fluid inflow piping (270).

In detail, when the valve member (280) is reduced in opening degree to reduce the inflow rate of the external fluid, the driving unit cooling fluid introduced through the guide piping (250) may increase in inflow rate. Thus, the driving unit cooling fluid introduced into the cooling fluid inflow hole (117*a*) increases in amount to actively cool the first driving part (210*a*). It may be adopted when the driving unit (210) has a high rotation speed.

When the first driving part (210*a*) has a low rotation speed, the valve member (280) may increase in opening degree to increase the inflow rate of the external fluid, thereby improving compression efficiency.

That is, it is preferable that the valve member (280) is controlled in opening degree thereof according to the rotation speed of the first driving part (210*a*) and thus is controlled in opening degree thereof.

Alternatively, it is preferable that the valve member (280) is controlled in opening degree thereof according to a pressure required at an outlet of the first compression part (230*a*), i.e., a load of the compression unit (230) and thus is controlled in opening degree thereof.

Figure 8:
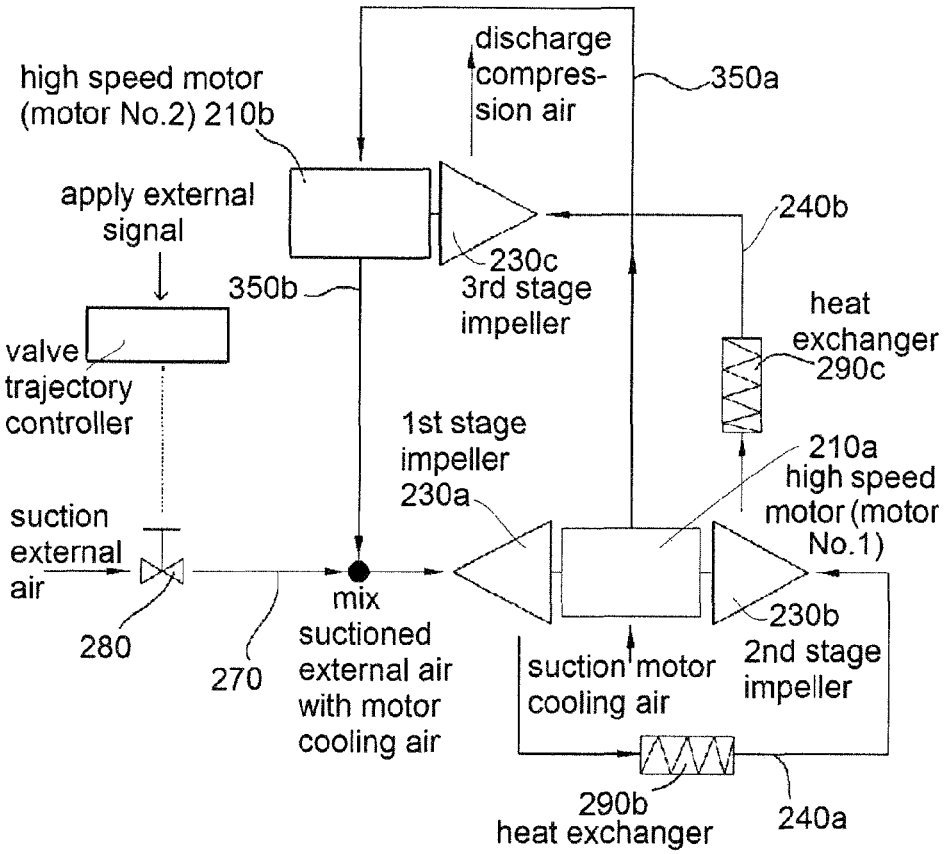
FIG. 8 is a view of another further example of FIG. 7.

Next, FIG. 8 is a view illustrating further another example of FIG. 7.

Referring to FIG. 8, although most of constitutions are almost the same as those of the above-described example of FIG. 7, there is a difference in that a first guide piping (350*a*) communicates with the inside of the second driving part (210*b*) to communicate with the first compression part (230*a*) by successively passing through the second driving part (210*b*) and a second guide piping (350*b*).

According to the present embodiment, the number of processes for providing an additional constitution to combine the first guide piping (350*a*) with the second guide piping (350*b*) may be reduced.

The invention claimed is:

1. A turbo machine system comprising:

a driving unit having a rotor and a stator;

a compression unit for compressing a working fluid, the compression unit having an impeller interlocked with the rotor to rotate;

a guide piping for guiding a driving unit cooling fluid, which driving unit cooling fluid is introduced into the driving unit and discharged to an outside of the driving unit after passing through an inside of the driving unit, into the compression unit as the working fluid; and an external fluid inflow piping disposed on one side of the guide piping to communicate with the guide piping;

wherein the external fluid inflow piping guides an external fluid via a differential pressure between an end of the external fluid inflow piping and an inside of the guide piping, such that the external fluid is introduced into the guide piping;

wherein the external fluid inflow piping further comprises a valve member for adjusting an inflow rate of the external fluid;

wherein the guide piping further comprises a heat exchange unit for cooling the driving unit cooling fluid that is discharged after cooling the driving unit, the heat exchange unit situated upstream of the compression unit such that the driving unit cooling fluid, discharged from the driving unit, is cooled before being guided into the compression unit as the working fluid; and wherein the working fluid, the driving unit cooling fluid, and the external fluid are gaseous air.

2. The turbo machine system of claim 1, wherein the external fluid inflow piping has one end that communicates with the inside of the guide piping and another end that is exposed to air.

3. The turbo machine system of claim 1, wherein the external fluid inflow piping has one end that communicates with the inside of the guide piping and another end that communicates with an external fluid storage part in which the external fluid is stored.

4. The turbo machine system of claim 1, wherein the valve member is controlled in operation according to a rotation speed of the driving unit.

5. The turbo machine system of claim 1, wherein the impeller is accommodated in an impeller housing having an inflow hole and a discharge hole, and the external fluid inflow piping communicates with the inflow hole.

* * * * *